US011634854B2

(12) United States Patent
Nakashima et al.

(10) Patent No.: US 11,634,854 B2
(45) Date of Patent: Apr. 25, 2023

(54) WATER TRANSMISSION DEVICE AND WASHING MACHINE INCLUDING THE SAME

(71) Applicant: Samsung Electronics Co., Ltd, Suwon-si (KR)

(72) Inventors: Takahiro Nakashima, Kanagawa (JP); Kazushi Mori, Kanagawa (JP); Yoshiyuki Nishioka, Kanagawa (JP); Yuichi Suzuki, Kanagawa (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 736 days.

(21) Appl. No.: 16/684,570

(22) Filed: Nov. 14, 2019

(65) Prior Publication Data

US 2020/0149209 A1 May 14, 2020

(30) Foreign Application Priority Data

Nov. 14, 2018 (JP) ..... JP2018-213952A
Oct. 21, 2019 (KR) ..... 10-2019-0130574

(51) Int. Cl.
*D06F 39/08* (2006.01)
*D06F 39/10* (2006.01)
(Continued)

(52) U.S. Cl.
CPC ..... *D06F 39/085* (2013.01); *D06F 39/10* (2013.01); *F04B 17/00* (2013.01); *F04B 53/16* (2013.01);
(Continued)

(58) Field of Classification Search
CPC .. F04D 29/4273; F04D 29/708; F04D 29/007; F04D 29/4293; F04D 29/406;
(Continued)

(56) References Cited

U.S. PATENT DOCUMENTS 4,465,428 A * 8/1984 Lindberg ..... A61H 33/60 415/121.3
5,975,846 A 11/1999 Wistinghausen
(Continued)

FOREIGN PATENT DOCUMENTS

DE 4302497 A1 8/1994
EP 0833003 A1 4/1998
(Continued)

OTHER PUBLICATIONS

Supplementary European Search Report dated Sep. 24, 2021 in connection with European Patent Application No. 19 88 5492, 7 pages.
(Continued)

*Primary Examiner* — Philip E Stimpert

(57) ABSTRACT

A water transmission device and a washing machine including the same. The washing machine includes a water transmission device configured to discharge water in a washing tub, wherein the water transmission device includes a filter case which is disposed under the washing tub and accommodates a filter, and into which the water in the washing tub is introduced, a pump case connected to the filter case and accommodating an impeller configured to suction the water in the filter case and discharge, a motor configured to rotate the impeller, a suction hole through which a side portion of the pump case facing a center of the impeller and a side portion of the filter case, and an outlet which is open downward from a lowest end inside the pump case and communicates with a water discharge pipeline.

10 Claims, 10 Drawing Sheets

(51) Int. Cl.

| | |
|---|---|
| ***F04D 29/42*** | (2006.01) |
| ***F04D 29/70*** | (2006.01) |
| ***F04B 53/20*** | (2006.01) |
| ***F04B 53/16*** | (2006.01) |
| ***F04B 17/00*** | (2006.01) |

(52) U.S. Cl.
CPC ..... *F04B 53/20* (2013.01); *F04D 29/4273* (2013.01); *F04D 29/708* (2013.01)

(58) Field of Classification Search
CPC ..... D06F 39/08; D06F 39/083; D06F 39/085; D06F 2105/08; D06F 2103/42
USPC ..... 68/208
See application file for complete search history.

(56) References Cited

U.S. PATENT DOCUMENTS

| | | | | |
|---|---|---|---|---|
| 6,167,733 | B1 | 1/2001 | Lee | |
| 7,243,512 | B2 | 7/2007 | Kim et al. | |
| 7,966,848 | B2 | 6/2011 | Jang et al. | |
| 8,881,555 | B2 | 11/2014 | Kim et al. | |
| 8,888,429 | B2 | 11/2014 | Pamer et al. | |
| 9,500,219 | B2 | 11/2016 | Aoshima | |
| 9,683,572 | B2 | 6/2017 | Liang et al. | |
| 2007/0297870 | A1 | 12/2007 | Vrana et al. | |
| 2008/0276657 | A1* | 11/2008 | Kim | D06F 39/083 210/416.1 |
| 2017/0096771 | A1* | 4/2017 | Kim | D06F 39/088 |
| 2017/0233938 | A1 | 8/2017 | Hwang et al. | |

FOREIGN PATENT DOCUMENTS

| | | | |
|---|---|---|---|
| JP | 2015-121234 | A | 7/2015 |
| JP | 3200554 | U | 10/2015 |
| KR | 20-1999-0030546 | U | 7/1999 |
| KR | 10-2008-0099113 | A | 11/2008 |

OTHER PUBLICATIONS

International Search Report dated Mar. 2, 2020 in connection with International Patent Application No. PCT/KR2019/014299, 5 pages.

* cited by examiner

WATER TRANSMISSION DEVICE AND WASHING MACHINE INCLUDING THE SAME

CROSS-REFERENCE TO RELATED APPLICATIONS

This application is based on and claims priority under 35 U.S.C. § 119 to Japanese Patent Application No. 2018-213952 filed on Nov. 14, 2018 in the Japanese Patent Office and Korean Patent Application No. 10-2019-0130574 filed on Oct. 21, 2019 in the Korean Intellectual Property Office, the disclosures of which are herein incorporated by reference in their entirety.

BACKGROUND

1. Field

Embodiments of the present disclosure relate to a water transmission device capable of suppressing noise when water is transmitted and being manufactured with a low cost and a washing machine including the same.

2. Description of the Related Art

A washing machine may include a water transmission device configured to discharge or circulate water in a washing tub.

As one example of a water transmission device, a water discharge device including a case member in which a filter is installed is proposed in Japanese Unexamined Patent Publication No. 2016-158743 (Published on Sep. 5, 2016). The case member of the water discharge device includes a case inlet path through which washing water is suctioned from a washing tub, a case outlet path through which the washing water is guided to be discharged from the case member to the outside of a washing machine, a water discharge pump coupling part in which a water discharge pump is installed, and a filter accommodation space for accommodating a filter member.

The case inlet path is connected to a side portion of the filter accommodation space, and the case outlet path is connected to an upper portion of the water discharge pump coupling part. Water in the washing tub is introduced into the case member through the case inlet path and is discharged to the outside through the case outlet path by operation of the water discharge pump.

Such a water discharge device barely generates noise in a case in which the case member is filled with washing water. However, in a case in which the washing water in the case member decreases and air is introduced into the case member and mixed with the washing water, high operating noise is generated. This noise may be unpleasant to a user.

A method of additionally installing a sound absorbing material, a soundproof material, or the like or changing a pump with a high performance pump may be considered in order to reduce the noise of the water discharge device, but in this case, a cost is increased. Since cost competition is fierce in the market of a washing machine which is a general household appliance, such a countermeasure is practically difficult. In a general washing machine, since a water discharge device is installed in a narrow and restricted space of a floor side, there is a height limitation as well.

SUMMARY

Therefore, it is an aspect of the present disclosure to provide a water transmission device capable of reducing noise when water is transmitted and a washing machine including the same.

It is another aspect of the present disclosure to provide a water transmission device capable of being manufactured with a low cost and a washing machine including the same.

Additional aspects of the disclosure will be set forth in part in the description which follows and, in part, will be obvious from the description, or may be learned by practice of the disclosure.

In accordance with one aspect of the present disclosure, a washing machine includes a water transmission device configured to discharge water in a washing tub, wherein the water transmission device includes a filter case which is disposed under the washing tub and accommodates a filter, and into which the water in the washing tub is introduced, a pump case connected to the filter case and accommodating an impeller configured to suction the water in the filter case and discharge, a motor configured to rotate the impeller, a suction hole through which a side portion of the pump case facing a center of the impeller communicates with a side portion of the filter case, and an outlet which is open downward from a lowest end inside the pump case and communicates with a water discharge pipeline.

The water discharge pipeline may laterally extend under the pump case.

The washing machine may further include an inlet which is formed on an upper region of a side surface of the filter case and into which water in the washing tub is introduced, and an inflow pipeline extending from the inlet in a direction of the water discharge pipeline and connected to a connecting pipe expending from the washing tub.

The motor may rotate the impeller in a forward or reverse direction according to a state of an input current thereof. Since the motor rotates the impeller in a state in which a rotating direction is not determined, the rotating direction does not have to be controlled. Accordingly, an inexpensive motor can be used.

An upper region inside the filter case communicates with an interior of the pump case through the suction hole.

A centerline of the suction hole may be aligned with a rotating center of the impeller and may be positioned at a higher level than a vertical center of the filter case.

The washing machine may further include one or more communicating paths which are provided under the suction hole and through which a lower region inside the filter case communicates with the outlet.

Both sides of each of the suction hole, the outlet, and the communicating path may be symmetrically formed with respect to a vertical line passing through a center of the impeller.

The communicating path may include a slit vertically cut downward from a lower end of the suction hole.

A cross-sectional area of the communicating path may be less than a cross-sectional area of the suction hole.

The communicating path horizontally may extend from a lowest end inside the filter case toward the outlet.

The filter case may be positioned such that a height of the lowest end inside the filter case is at a higher level than that of the water discharge pipeline.

In accordance with another aspect of the present disclosure, a washing machine includes a water transmission device configured to discharge water in a washing tub, wherein the water transmission device includes a filter case disposed under the washing tub and provided with an inlet through which the water in the washing tub is introduced, a pump case which is connected to the filter case and accommodates an impeller configured to suction the water in the filter case and discharge, wherein a suction hole of a side portion of the pump case communicates with an interior of the filter case and an outlet of a lower side of the pump case communicates with a water discharge pipeline, and a motor configured to rotate the impeller in a state in which a rotating direction is not determined.

In accordance with still another aspect of the present disclosure, a water transmission device includes a filter case which is disposed under a washing tub and accommodates a filter, and into which water in the washing tub is introduced, a pump case connected to the filter case and accommodating an impeller configured to suction the water in the filter case and discharge, a motor configured to rotate the impeller, a suction hole through which a side portion of the pump case facing a center of the impeller communicates with a side portion of the filter case, and an outlet which is open downward from a lowest end inside the pump case and communicates with a water discharge pipeline.

A centerline of the suction hole may be aligned with a rotating center of the impeller, and the suction hole may communicate with an upper region inside the filter case.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 10, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, a washing machine according to embodiments of the present disclosure will be described in detail with reference to the accompanying drawings.

The following description is essentially only an example, and does not limit the present disclosure, application, or usage. Upward, downward, left, right, forward, and rear directions used for describing the drawings are marked with arrows.

Figure 1:
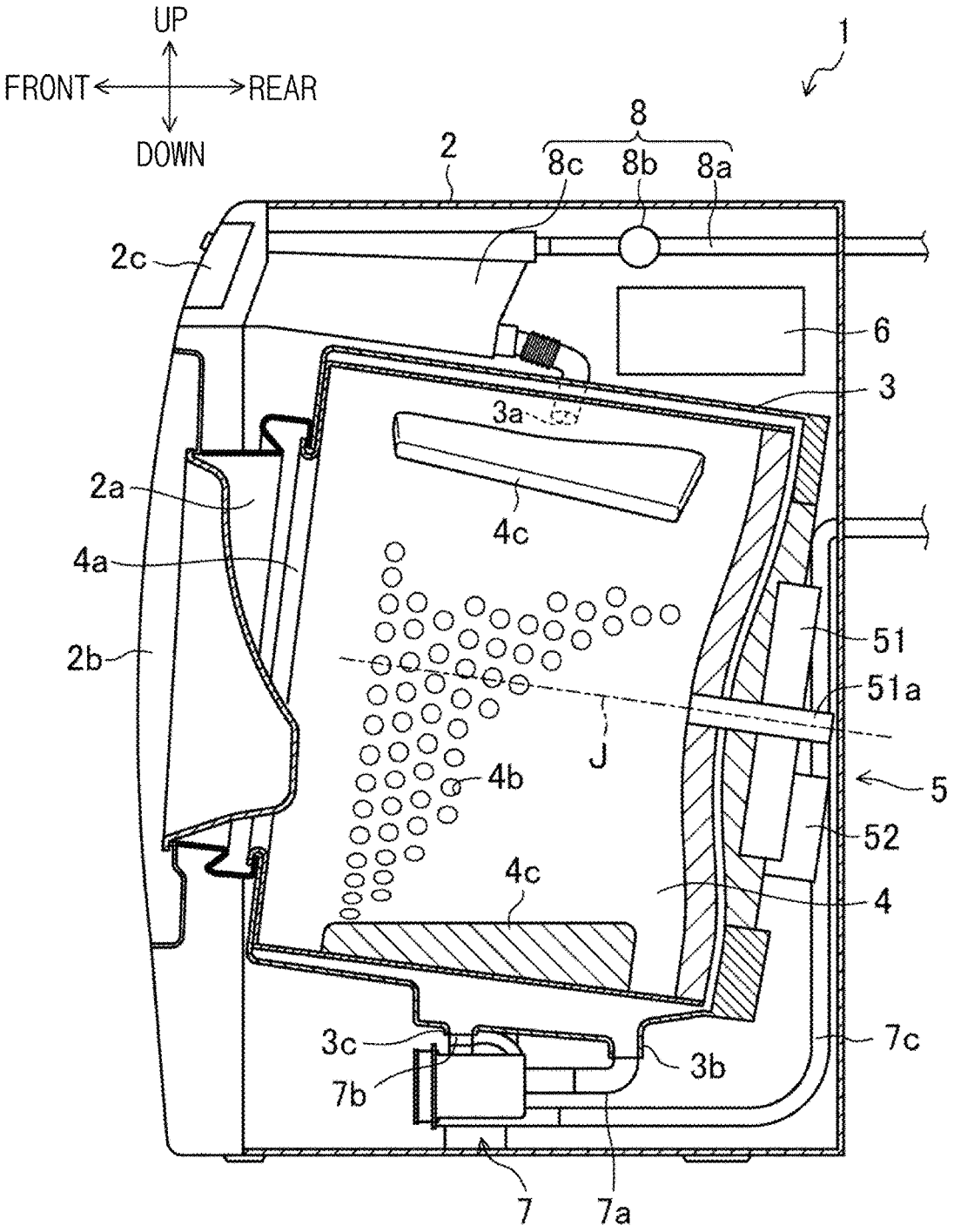
FIG. 1 is a cross-sectional view illustrating a washing machine to which a water transmission device according to an embodiment of the present disclosure is applied.

FIG. 1 is a cross-sectional view illustrating a washing machine to which a water transmission device according to an embodiment of the present disclosure is applied. A washing machine 1 is a drum type washing machine. The washing machine 1 may automatically perform a series of washing cycles including a washing cycle, a rinse cycle, and a spin cycle.

The washing machine 1 may include a main body 2, a washing tub 3, a drum 4, a driver 5, a controller 6, and a water transmission device 7.

The water transmission device 7 may perform a function of discharging water in the washing tub to the outside and a function of circulating the water in the washing tub. The water transmission device 7 may also only perform the function of discharging or circulating water. Hereinafter, a case in which the water transmission device 7 performs the function of discharging water will be mainly described.

The main body 2 is provided as a box-type body using a panel or frame and forms an exterior of the washing machine 1. The main body 2 includes a loading port 2*a* formed in a front surface thereof in a circular shape to load or unload laundry and a door 2*b* installed on the loading port 2*a* to open or close the loading port 2*a* and having a transparent window. A manipulation unit 2*c* may be installed above the loading port 2*a* of the main body 2. The manipulation unit 2*c* may include one or more switches or buttons for operating the washing machine 1 and a display configured to display an operation state.

The washing tub 3 is installed in the main body 2 and an interior of the washing tub 3 communicates with the loading port 2*a*. The washing tub 3 may be a cylindrical container having an opening connected to the loading port 2*a* and formed in a front surface of the washing tub 3 and may store washing water therein. The washing tub 3 may be disposed such that a central axis J is slightly inclined toward an upper side in front thereof. The washing tub 3 may be stably supported in a state in which the washing tub 3 is buffered by a plurality of dampers provided in the main body 2.

The drum 4 may be a cylindrical container having a diameter which is slightly less than that of the washing tub 3. The drum 4 may be rotatably installed in the washing tub 3 such that a rotating center thereof is aligned with the central axis J of the washing tub 3. The drum 4 includes a circular opening 4*a* corresponding to the loading port 2*a* in a front surface thereof. Laundry may be loaded in the drum 4 through the loading port 2*a* and the circular opening 4*a*.

The drum 4 includes a plurality of dewatering holes 4*b* formed in a side surface portion thereof and a plurality of stirring lifters 4*c* installed in a plurality of locations inside the side surface portion. The plurality of dewatering holes 4*b* may be formed throughout an entirety of the side surface portion of the drum 4. A front surface portion of the drum 4 may be rotatably supported by the loading port 2*a*.

The driver 5 is installed on a rear surface portion of the washing tub 3. The driver 5 may include a drive motor 51, an inverter 52, and the like. A shaft 51*a* of the drive motor 51 passes through the rear surface portion of the washing tub 3 and extends to an interior of the washing tub 3. The shaft 51*a* extending to the interior of the washing tub 3 is fixed at a center of a bottom surface portion of the drum 4.

Since the driver 5 is connected to the drum 4 through the shaft 51*a*, the driver 5 may directly drives the drum 4. Accordingly, the drum 4 may rotate in the washing tub 3 in a state in which the rotating center of the drum 4 is aligned with the central axis J of the washing tub 3.

A water supply unit 8 including a water supply pipe 8*a*, a water supply valve 8*b*, an agent input unit 8*c*, and the like may be provided above the washing tub 3.

An upper stream side end portion of the water supply pipe 8*a* may extend to the outside of the washing machine 1 to be connected to an external water source, and a lower stream side end portion thereof may be connected to a water supply hole 3*a* provided in an upper portion of the washing tub 3. The agent input unit 8*c* may accommodate a detergent, a fabric softener, and the like, mix the agents with water supplied from the outside, and input the agents mixed with the water to the washing tub 3.

The washing tub 3 includes a main water discharge pipe 3*b* and a sub-water discharge pipe 3*c* formed in a lower portion thereof. The main water discharge pipe 3*b* is connected to the water transmission device 7 through a first connecting pipe 7*a*, and the sub-water discharge pipe 3*c* is connected to the water transmission device 7 through the second connecting pipe 7*b*.

The controller 6 may be provided in an upper portion inside the main body 2. The controller 6 controls an overall operation of the washing machine 1. The controller 6 may include hardware such as a central processing unit (CPU) and a memory and software such as a control program, various types of data, and the like. The controller 6 may control the driver 5, the water supply valve 8*b*, the water transmission device 7, and the like according to instructions from the manipulation unit 2*c*. Accordingly, the washing machine 1 may perform a series of washing cycles including a washing cycle, a rinse cycle, and a spin cycle.

As illustrated in FIG. 1, the water transmission device 7 may be disposed under the washing tub 3. Specifically, the water transmission device 7 may be installed in a limited space between a bottom surface of the washing tub 3 and a bottom surface of the main body 2. Since the water transmission device 7 should be installed in the narrow space inside the washing machine 1 as described above, a height of the water transmission device 7 may be reduced.

Since the water transmission device 7 is connected to the main water discharge pipe 3*b* and the sub-water discharge pipe 3*c* in the lower portion of the washing tub 3 through the first connecting pipe 7*a* and the second connecting pipe 7*b*, respectively, water in the washing tub 3 may be introduced into the water transmission device 7. In addition, the water transmission device 7 is connected to an extension pipe 7*c* extending to the outside through a rear surface (at a position at a higher level than the water transmission device) of the main body 2 so as to forcibly discharge water to the outside of the washing machine. Accordingly, the water transmission device 7 may discharge unnecessary water in the washing tub 3 to the outside though the first connecting pipe 7*a*, the second connecting pipe 7*b*, and the extension pipe 7*c*.

Figure 2:
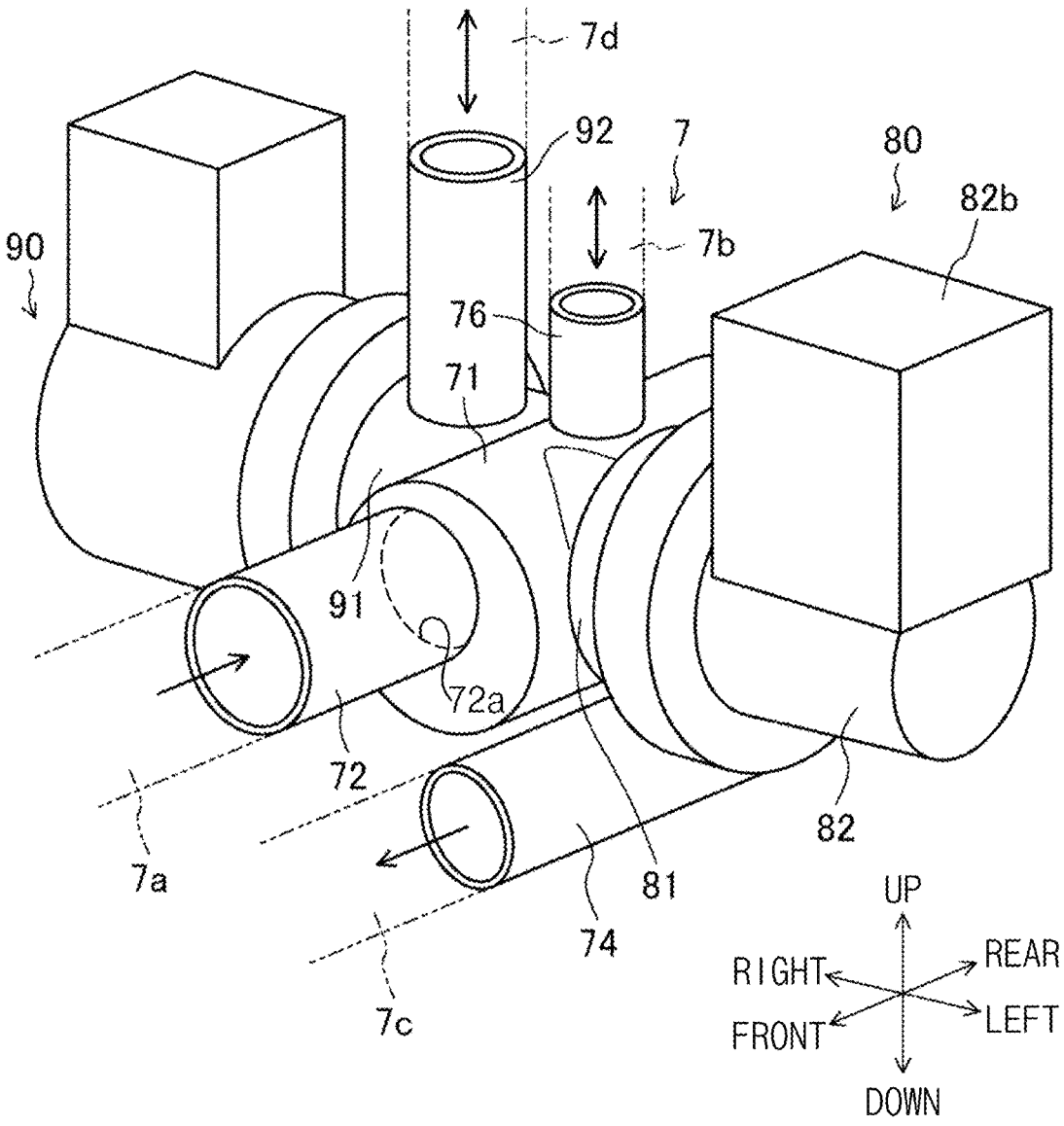
FIG. 2 is a perspective view illustrating the water transmission device according to the embodiment of the present disclosure.
Figure 3:
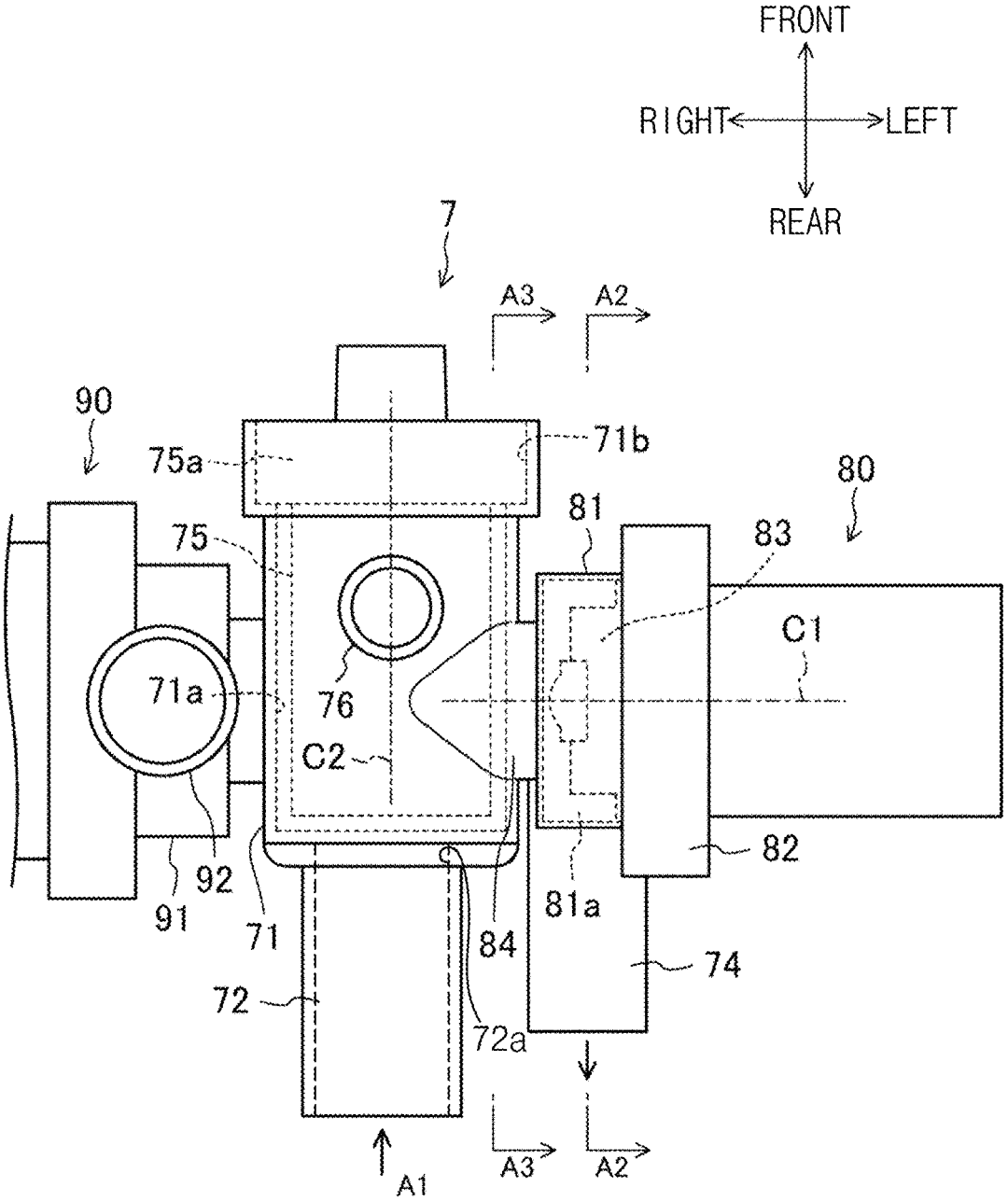
FIG. 3 is a plan view illustrating the water transmission device according to the embodiment of the present disclosure.
Figure 4:
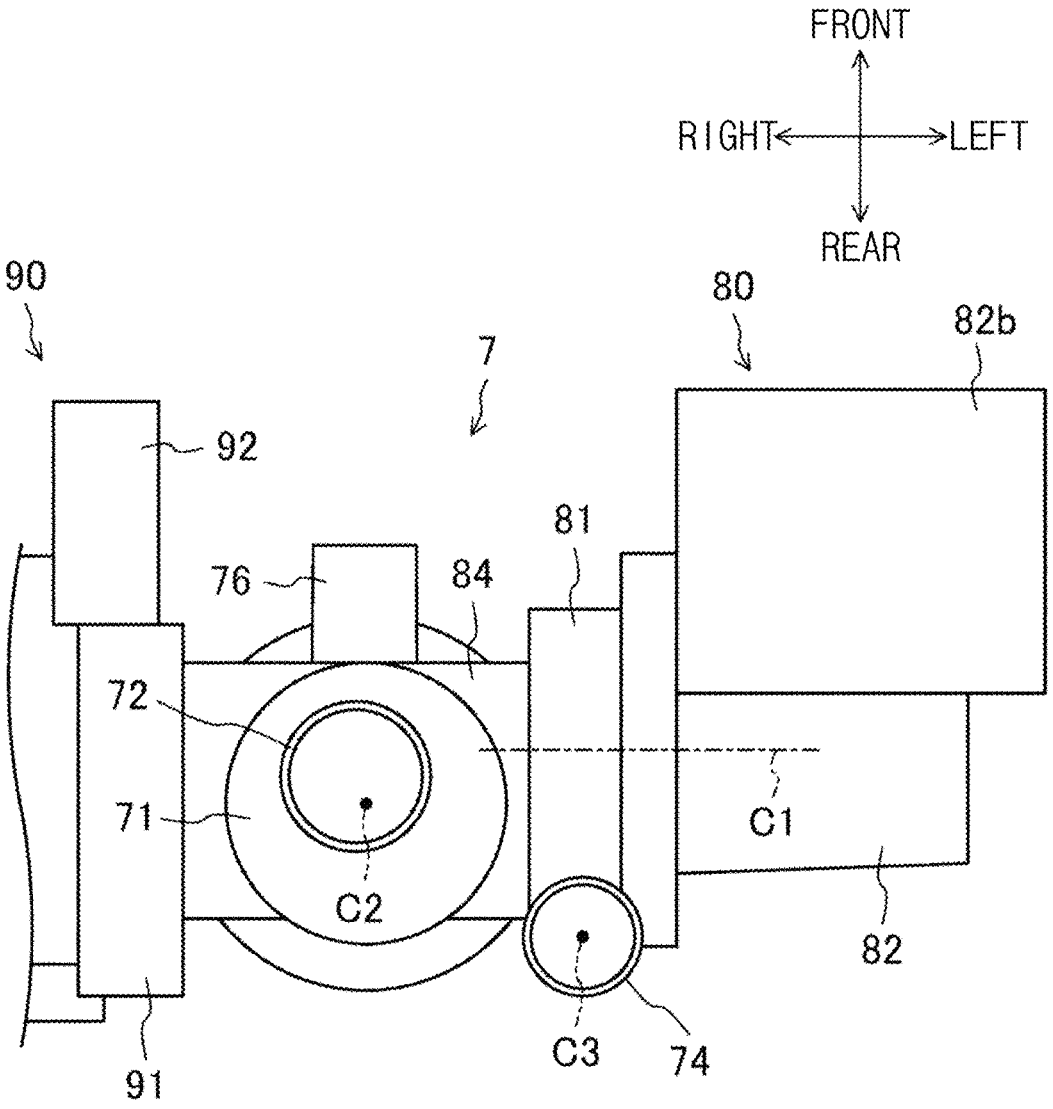
FIG. 4 is a view illustrating the water transmission device when viewed in a direction of an arrow A1 of FIG. 3.

Referring to FIGS. 2 to 4, the water transmission device 7 includes a filter case 71, an inflow pipeline 72, a water discharge pump 80, a water discharge pipeline 74, pump cases 81 and 91, a circulation pump 90, a circulation pipeline 92, and the like. The water transmission device 7 is formed by coupling the above-described parts.

The filter case 71, the inflow pipeline 72, the water discharge pipeline 74, and the pump cases 81 and 91 may be integrally formed using a synthetic resin. The water discharge pump 80 is detachably coupled to the pump case 81 disposed at one side, and the circulation pump 90 may be detachably installed on the pump case 91 disposed at the other side.

The filter case 71 is provided to have a cylindrical form having a relatively large diameter and includes a filter room 71*a* therein. The filter case 71 may be disposed under the washing tub 3 such that a centerline C2 maintains a substantially horizontal state.

Referring to FIG. 3, the filter room 71*a* of the filter case 71 accommodates a detachable cylindrical filter 75. The filter case 71 includes an installation port 71*b* of which one side is open for installing and separating the filter 75, and the filter 75 includes a cover 75*a* coupled to the installation port 71*b* of the filter case 71 and configured to seal the installation port 71*b*. The cover 75*a* may be integrally formed with the filter 75.

The filter 75 may have a cylindrical form and include a plurality of through holes capable of allowing water to pass therethrough and filter foreign materials. Accordingly, water introduced into the filter case 71 may pass through the filter 75 so that foreign materials such as lint, a button, and a clip may be filtered.

The filter case 71 includes an inlet 72*a*, through which water is introduced from the washing tub 3, in a side upper region positioned at a side opposite to a side of the installation port 71*b*. The inflow pipeline 72 may laterally extend from the inlet 72*a* toward the outside of the filter case 71. The inflow pipeline 72 is connected to a main water discharge pipe 3*b* of the washing tub 3 through the first connecting pipe 7*a*. Accordingly, water in the washing tub 3 may be introduced into the filter room 71*a* through the main water discharge pipe 3*b*, the first connecting pipe 7*a*, the inflow pipeline 72, and the inlet 72*a*.

The filter case 71 includes an air discharge pipe 76 slightly extending upward from an upper portion of the filter case 71. The air discharge pipe 76 is connected to the sub-water discharge pipe 3*c* of the washing tub 3 through the second connecting pipe 7*b*. Accordingly, air in the filter room 71*a* may be discharged into the washing tub 3 through the air discharge pipe 76 and the second connecting pipe 7*b*, and water in the washing tub 3 may be introduced into the filter room 71*a* not only through the inflow pipeline 72 but also through the second connecting pipe 7*b* and the air discharge pipe 76.

The water discharge pump 80 is installed beside the filter case 71. The water discharge pump 80 may suction water in the filter case 71 and discharge the water to the outside according to control of the controller 6. The water discharge pump 80 may include a pump case 81, an alternating current (AC) motor 82, an impeller 83, and the like.

Referring to FIGS. 3 and 4, the pump case 81 may be provided to have a cylindrical form. The pump case 81 is coupled to a side portion of the filter case 71 through a coupling part 84 such that a centerline C1 is perpendicular to the centerline C2 of the filter case 71. The pump case 81 may be integrally formed with the filter case 71 in a process in which the filter case 71 is molded.

Figure 5:
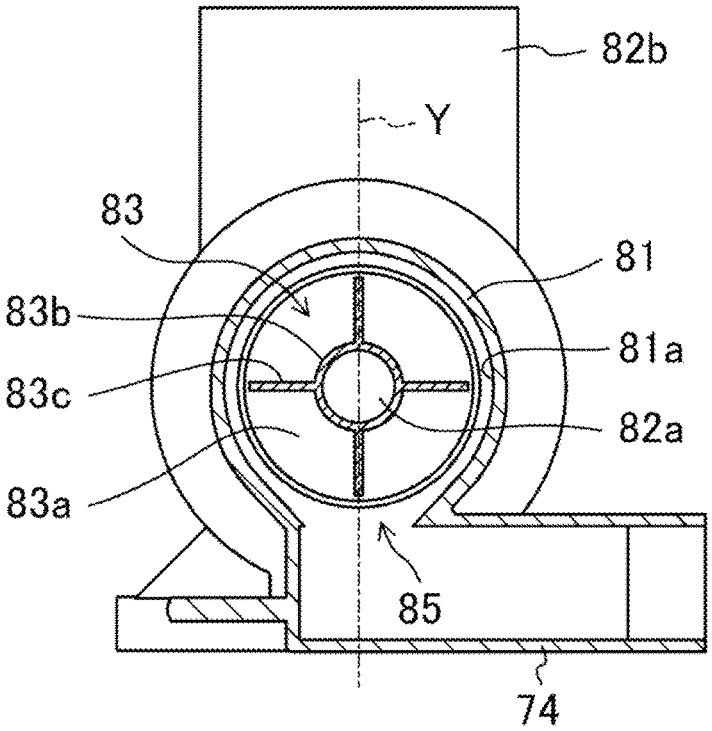
FIG. 5 illustrates a cross-sectional view taken along line A2-A2 of FIG. 3.
Figure 7:
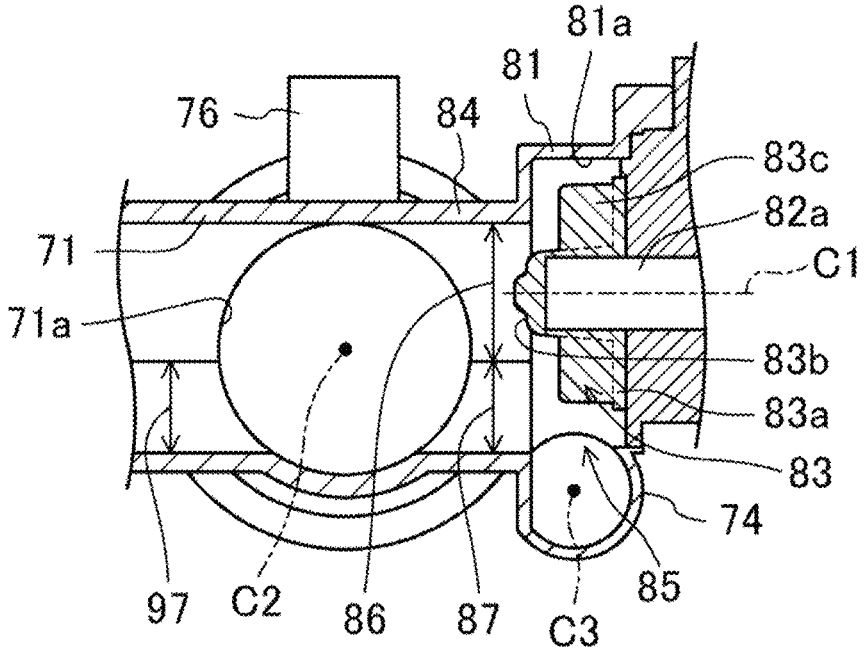
FIG. 7 illustrates a cross-sectional view taken along line A4-A4 of FIG. 6.

Referring to FIGS. 5 and 7, the pump case 81 forms a pump room 81*a* for accommodating the impeller 83. The impeller 83 is for suctioning and discharging water in the filter case 71 and includes a circular plate type base 83*a*, a cylindrical boss 83*b* provided at a center of the base 83*a*, and a plurality of blades 83*c* radially extending from the boss 83*b* and integrally provided with the base 83*a*.

Each of the blades 83*c* of the impeller 83 may have a flat plate form radially extending from the boss 83*b*, and the blades 83*c* may be disposed to be spaced a predetermined distance from each other in a circumferential direction. In the impeller 83, the plurality of blades 83*c* are point-symmetric with respect to a rotating center thereof. The impeller 83 is rotatably installed in the pump case 81 in a state in which a central axis is aligned with the centerline C1 of the pump case 81.

The AC motor 82 is installed beside the pump case 81 to rotate the impeller 83. An output shaft 82*a* of the AC motor 82 is fixed to the boss 83*b* of the impeller 83. The AC motor 82 may directly receive commercial power to rotate at revolutions corresponding to a frequency of the commercial frequency. The AC motor 82 may include a converter 82*b* configured to convert the commercial power into AC power having a predetermined voltage.

The AC motor 82 is a simple motor configured to rotate or stop according to on-off control of the controller 6. Accordingly, when the AC motor 82 is used, the water transmission device 7 may be manufactured with a very low cost.

The AC motor 82 may rotate the impeller in a forward or reverse direction according to a state of a current received when operation thereof starts. That is, a direction in which the output shaft 82*a* rotates is determined according to a state of power applied when the operation starts. A rotating direction of the impeller 83 is not determined when the operation starts.

The water discharge pipeline 74 is integrally formed under the pump case 81. The water discharge pipeline 74 may horizontally extend in a direction which is the same as that of the inflow pipeline 72, under the pump case 81. The water discharge pipeline 74 is connected to the extension pipe 7*c* extending to the outside of the washing machine 1. Accordingly, water discharged according to operation of the water discharge pump 80 may be discharged to the outside of the washing machine 1 through the water discharge pipeline 74 and the extension pipe 7*c*.

In the water transmission device 7, since the water discharge pipeline 74 and the inflow pipeline 72 horizontally extend in the same direction, a total height of the water transmission device 7 may be decreased. As illustrated in FIG. 1, the water transmission device 7 can be easily installed in a narrow space under the washing tub 3 and pipes thereof can be easily connected.

Referring to FIGS. 5 and 7, the pump case 81 includes an outlet 85 that is open downward from a lowest end of the pump room 81*a* and communicates with the water discharge pipeline 74. The outlet 85 is open at a lower side of the pump room 81*a* in a radial direction. A center of the outlet 85 may be aligned with a vertical line Y passing through centers of the pump room 81*a* and the impeller 83, and both sides of the outlet 85 may be symmetrical with respect to the vertical line Y.

Since the outlet 85 is open downward from the lowest end of the pump case 81, even in a case in which air is introduced in the pump room 81*a*, water in the pump room 81*a* may be easily discharged. In addition, since air is difficult to be introduced into the pump room 81*a* through the outlet 85, noise generation, which occurs when air is introduced in the pump room 81*a* can be suppressed.

Since the outlet 85 is open at the lower side of the pump room 81*a* in the radial direction, when the impeller 83 rotates, water in the pump room 81*a* can be effectively discharged. In addition, since the outlet 85 is formed such that both sides are symmetrical with respect to the vertical line Y passing through the centers of the pump room 81*a* and the impeller 83, water in the pump room 81*a* can be discharged regardless of a direction in which the impeller 83 rotates. Accordingly, water can be stably discharged regardless of a rotating direction of the impeller 83.

Figure 6:
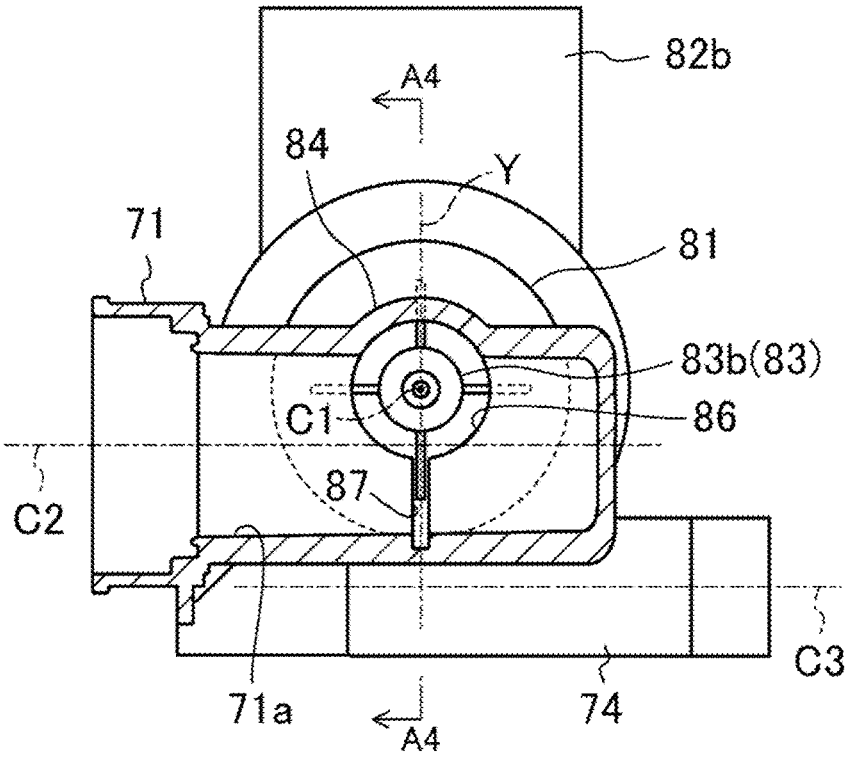
FIG. 6 illustrates a cross-sectional view taken along line A3-A3 of FIG. 3.

Referring to FIGS. 6 and 7, the pump room 81*a* communicates with the filter room 71*a* through a suction hole 86 through which a side portion of the pump case 81 communicates with a side portion of the filter case 71. Accordingly, when the impeller 83 rotates due to operation of the AC motor 82, water may be suctioned into the pump room 81*a* from the filter room 71*a* through the suction hole 86.

The side portion of the pump case 81 facing a center of the impeller 83 communicates with an upper region inside the filter case 71 through the suction hole 86. A centerline of the suction hole 86 may be aligned with the centerline C1 of the impeller and may be positioned at a position at a higher level than a vertical center C2 of the filter case 71. The suction hole 86 may be formed such that both sides are symmetrical with respect to the vertical line Y passing through the center of the impeller 83 like the outlet 85.

The suction hole 86 faces the boss 83*b* positioned at the center of the impeller 83, and the blade 83*c* and the base 83*a* of the impeller 83 face a side surface of the pump room 81*a* expanding toward a perimeter of the suction hole 86. Accordingly, the impeller 83 may effectively suction water from the filter room 71*a* to the pump room 81*a* and discharge the water toward the outlet 85 using a centrifugal force. The water discharge pump 80 may provide the same discharge force regardless of a direction in which the impeller 83 rotates.

As illustrated in FIGS. 5 and 6, in the water transmission device 7, the suction hole 86 is disposed at upper side of the side portion of the filter case 71, and the pump case 81 is disposed at a relatively higher level than the filter case 71. That is, the filter case 71 may be disposed between an upper end of the pump case 81 and a lower end of the water discharge pipeline 74 in a vertical direction. The centerline C2 of the filter case 71 is positioned between the centerline C1 of the pump case 81 and a centerline C3 of the water discharge pipeline 74.

A total height of the water transmission device 7 may be reduced in the vertical direction although the outlet 85 is disposed at the lowest end of the pump case 81 and the water discharge pipeline 74 is disposed at a lower side of the pump room 81*a*. Accordingly, the water transmission device 7 can be easily installed in a narrow space under the washing tub 3.

Water may remain in the filter room 71*a* due to a structure in which an upper region of the filter room 71*a* communicates with the pump room 81*a* through the suction hole 86. However, as illustrated in FIGS. 6 to 8, in the water transmission device 7, since one or more communicating paths 87 are provided under the suction hole 86 such that a lower region inside the filter case 71 directly communicates with a side of the outlet 85, such a problem can be solved.

Figure 8:
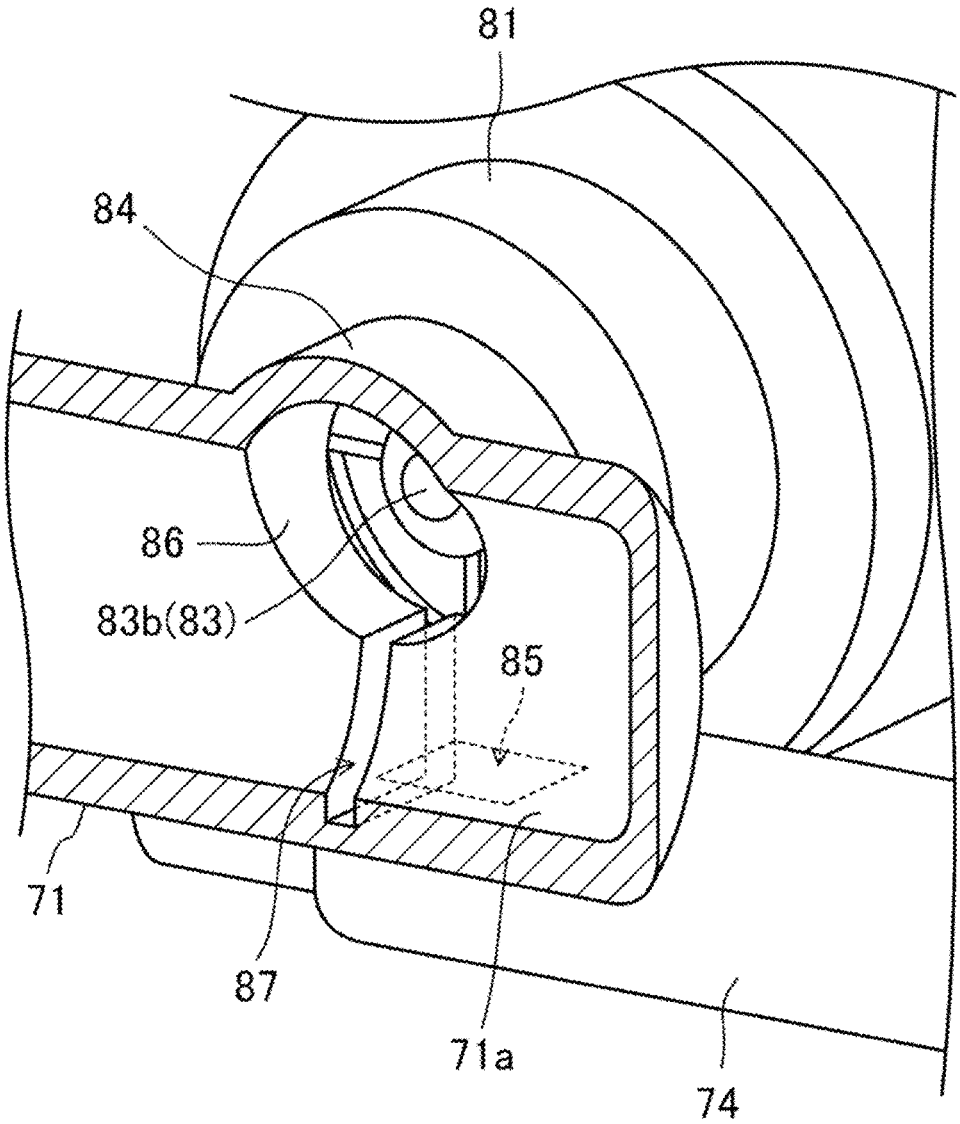
FIG. 8 is a perspective view illustrating main portions of FIG. 6.

As illustrated in FIGS. 6 and 8, the communicating path 87 may include a slit vertically cut downward from a lower end of the suction hole 86 and having a linear lateral cross-section. A lower end of the communicating path 87 may horizontally extend from a bottom side of the filter room 71*a* toward the outlet 85. A cross-sectional area of the communicating path 87 is less than a cross-sectional area of the suction hole 86, and both sides thereof may be symmetrically formed with respect to the vertical line Y passing through the center of the impeller 83 like the outlet 85.

Since an open area of the communicating path 87 is small, the communicating path 87 hardly affects a discharge force of the water discharge pump 80 although the communicating path 87 is formed at a position facing the blade 83*c*. In addition, since the both sides of the communicating path 87 are symmetrically formed with respect to the vertical line Y, a difference in discharge force is not generated regardless of a direction in which the impeller 83 rotates.

Since the lower region of the filter room 71*a* directly laterally communicates with the outlet 85 through the communicating path 87, generation of water remaining in the filter room 71*a* can be prevented. Since the communicating path 87 improves water discharge effect, operation noise of the water transmission device 7 can be reduced.

Figure 9:
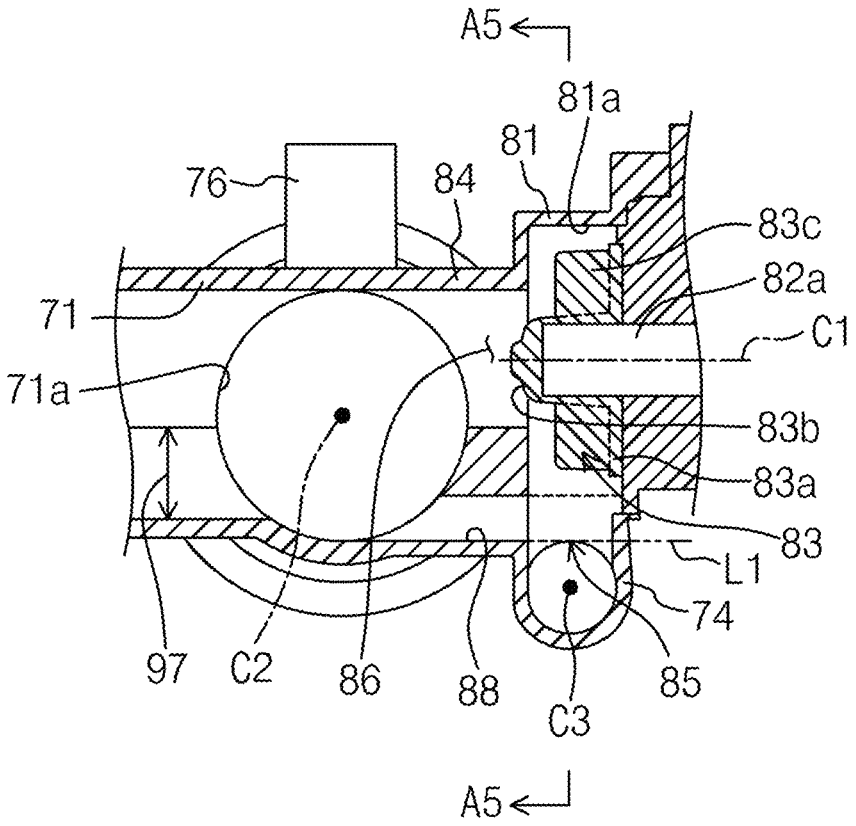
FIG. 9 is a cross-sectional view illustrating a modified example of a communicating path of the water transmission device according to an embodiment of the present disclosure.
Figure 10:
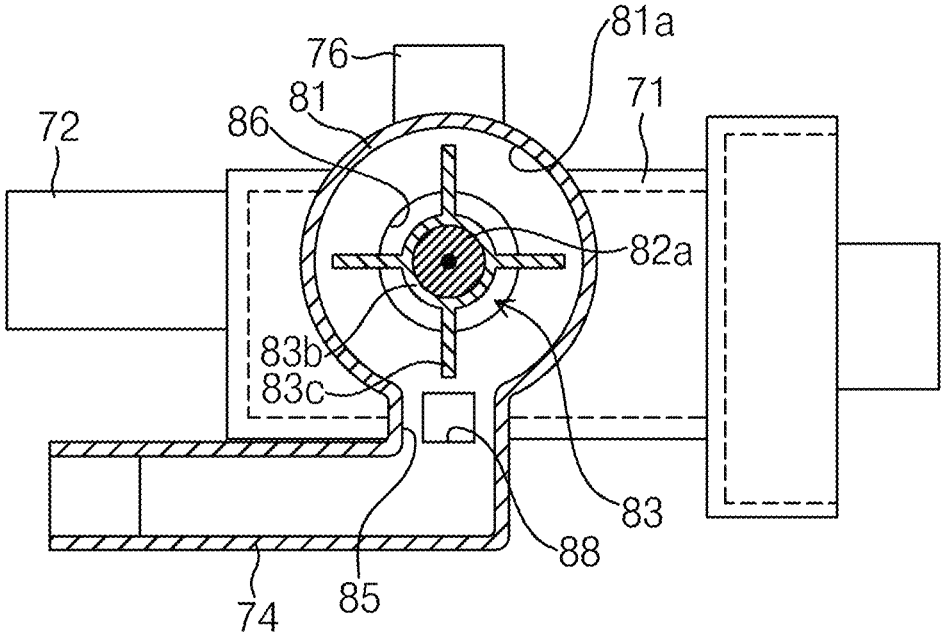
FIG. 10 illustrates a cross-sectional view taken along line A5-A5 of FIG. 9.

FIGS. 9 and 10 show a modified example of the communicating path. In FIGS. 9 and 10, a communicating path 88 may directly horizontally extend from a lowest end inside a filter case 71 toward an outlet 85 regardless of a suction hole 86. In this case, the filter case 71 may be positioned such that a height of the lowest end inside the filter case 71 may be at a higher level than an upper end inside a water discharge pipeline 74, and an exit of the communicating path 88 may communicate with the outlet 85 above the water discharge pipeline 74. The upper end inside the water discharge pipeline 74 may be positioned at a lower level than an extension line L1 horizontally extending from a lowest end inside a filter room 71*a*.

Here, an example in which one communicating path 88 is independently formed is proposed, but a form of the communicating path may be variously changed. A plurality of communicating paths may be vertically or horizontally provided to be spaced apart from each other. A cross-sectional shape thereof may also be changed to a circular shape, an oval shape, a polygonal shape, a tapered shape, a V shape, or the like.

Referring to FIGS. 4 and 7, a circulation pump 90 may be installed beside the filter case 71 disposed at a side opposite to a side of a water discharge pump 80. The circulation pump 90 also includes a pump case 91 for accommodating an impeller, and the like, and may be formed to be substantially the same as the water discharge pump 80. For example, a communicating path 97 (see FIG. 7) having the same form as a communicating path 87 of the water discharge pump 80 may be provided between the pump case 91 and the filter case 71.

The circulation pump 90 may suction water from the filter case 71 and discharge the water to the circulation pipeline 92 extending upward from the pump case 91 according to control of the controller 6. The water discharged by the circulation pump 90 returns to the washing tub 3 through the circulation pipeline 92 and the circulation pipe 7*d* (see FIG. 2).

Hereinafter, operation of the water transmission device 7 will be described.

Water supplied to the washing tub 3 is introduced into the water transmission device 7 through the first connecting pipe 7*a* and the second connecting pipe 7*b*. Since air in the filter room 71*a* is discharged to the washing tub 3 through an air discharge pipe 76, the filter room 71*a* is filled with the water.

Water in the washing tub may also be introduced into the filter room 71*a* through the air discharge pipe 76 above the filter room 71*a*. When an air discharge pipe is installed in a pump case accommodating the impeller 83, water suctioned into the impeller 83 and water introduced from the air discharge pipe interfere with each other, and thus a water flow may be hindered, or noise may be generated. However, in the water transmission device 7 according to the present disclosure, since the air discharge pipe 76 is disposed above the filter room 71*a* and the impeller 83 is positioned in a pump case 81 separated from the filter room 71*a*, such water flow hindrance can be prevented and the noise can be suppressed.

The controller 6 may drive an AC motor 82 to rotate the impeller 83, and when the impeller 83 is rotated, water suctioned from the filter room 71*a* to the pump room 81*a* is discharged through the outlet 85. In this case, although the AC motor 82 rotates the impeller 83 in a forward or reverse direction according to an input current thereof when operation thereof starts, since the water discharge pump 80 provides the same discharge force regardless of a direction in which the impeller 83 rotates, water can be stably and effectively discharged.

In the water transmission device 7, when a water level is lowered while water is discharged, air is introduced into the filter room 71*a* and mixed therewith. However, in the water transmission device 7 according to the present embodiment, since the outlet 85 is positioned at a lowest end of the pump case 81 and a lower region of the filter room 71*a* communicates with the outlet 85 through the communicating path 87, even when an amount of water in the filter room 71*a* is small, the water may be easily discharged. Accordingly, noise due to the mixed air can be effectively reduced.

In the water transmission device 7, even in a case in which water in the washing tub 3 is circulated using the circulation pump 90, the same effect obtained in a case in which the water discharge pump 80 is used can be obtained.

Here, an example case in which the water transmission device 7 is applied to a washing machine has been described, but the water transmission device 7 may be applied to various machines or apparatuses having similar objectives. The washing machine to which the water transmission device is applied is not limited to a drum type washing machine. For example, the water transmission device may also be applied to a vertical type washing machine.

As is apparent from the above description, a water transmission device and a washing machine according to the embodiment of the present disclosure can effectively reduce noise when water is transmitted.

Since a water transmission device according to the embodiment of the present disclosure uses an AC motor of which a rotating direction is not determined when operation thereof is started, the water transmission device can be manufactured with a low cost.

Although the present disclosure has been described with various embodiments, various changes and modifications may be suggested to one skilled in the art. It is intended that the present disclosure encompass such changes and modifications as fall within the scope of the appended claims.

What is claimed is:

1. A washing machine comprising:

a water transmission device configured to discharge water in a washing tub, the water transmission device including:

a filter case disposed under the washing tub, the filter case accommodating a filter, and the filter case accepting the water from the washing tub;

a pump case connected to the filter case, the pump case accommodating an impeller, the impeller configured to suction the water in the filter case and discharge;

a motor configured to rotate the impeller;

a coupling part separating the pump case from the filter case;

a suction hole formed through the coupling part and communicating a side portion of the pump case facing a center of the impeller with a side portion of the filter case;

an outlet opened downward from a lowest end inside the pump case, the outlet communicating with a water discharge pipeline; and a communicating path provided under the suction hole, the communicating path communicating a lower region inside the filter case with the outlet and including a slit vertically cut downward through the coupling part to extend from a lower end of the suction hole.

2. The washing machine of claim 1, wherein the water discharge pipeline laterally extends under the pump case.

3. The washing machine of claim 2, further comprising:

an inlet formed on an upper region of a side surface of the filter case, the inlet accepting the water from the washing tub; and an inflow pipeline extending from the inlet in a direction of the water discharge pipeline, the inflow pipeline connected to a connecting pipe extending from the washing tub.

4. The washing machine of claim 1, wherein the motor is configured to rotate the impeller in a forward or a reverse direction according to a state of an input current thereof.

5. The washing machine of claim 1, wherein an upper region inside the filter case communicates with an interior of the pump case through the suction hole.

6. The washing machine of claim 5, wherein:

a centerline of the suction hole is aligned with a rotating center of the impeller, and the centerline of the suction hole positioned at a higher level than a vertical center of the filter case.

7. The washing machine of claim 1, wherein both sides of each of the suction hole, the outlet, and the communicating path are symmetrically formed with respect to a vertical line passing through the center of the impeller.

8. The washing machine of claim 1, wherein a cross-sectional area of the communicating path is less than a cross-sectional area of the suction hole.

9. The washing machine of claim 1, wherein the communicating path horizontally extend from a lowest end inside the filter case toward the outlet.

10. The washing machine of claim 9, wherein the filter case is positioned such that a height of a lowest point of the lowest end inside the filter case is at a higher level than that of a highest point of the water discharge pipeline.

* * * * *